United States Patent [19]

Coffman

[11] 4,006,534

[45] Feb. 8, 1977

[54] VARIABLE AIR SUPPLY FOR FABRIC DRYERS

[75] Inventor: Robert B. Coffman, Crystal Lake, Ill.

[73] Assignee: Norman Dryer Co., Inc., Crystal Lake, Ill.

[22] Filed: Aug. 22, 1975

[21] Appl. No.: 607,017

[52] U.S. Cl. ..... 34/54

[51] Int. Cl.[2] ..... F26B 21/12

[58] Field of Search ..... 34/53, 54, 45, 51, 131; 432/105

[56] References Cited

UNITED STATES PATENTS

| | | | |
|---|---|---|---|
| 2,569,515 | 10/1951 | Collins | 34/54 |
| 2,780,008 | 2/1957 | Stickel | 34/54 |
| 3,071,864 | 1/1963 | Menk | 34/54 |
| 3,098,726 | 7/1963 | Stone | 34/54 |
| 3,750,304 | 8/1973 | Ghadiali | 34/54 |

*Primary Examiner*—John J. Camby
*Assistant Examiner*—Larry I. Schwartz
*Attorney, Agent, or Firm*—Howard H. Rogers, Jr.

[57] ABSTRACT

A fabric dryer including a damper in the air flow system thereof which reduces air flow through a load in the initial stages of drying and increases air flow during the terminal stages of drying to promote a faster drying cycle with less consumption of fuel.

3 Claims, 5 Drawing Figures

VARIABLE AIR SUPPLY FOR FABRIC DRYERS

BACKGROUND OF THE INVENTION

In fabric dryers, notably of the type such as are used in commerical laundries, dyeing plants, etc., heated air is drawn through the dryer at a constant rate over the anticipated drying time at considerable volume. Commonly, the burner which heats the air is a two stage burner which operates initially at a high output level to bring the load and the dryer itself quickly up to an elevated temperature and when that temperature is sensed by a sensor in the exhaust system, drops to a lower output level for drying. The high stage may cycle on and off to keep the contents up to temperature and compensate for the evaporative cooling effect of the water in the wet load. The input of large quantities of heat together with large volumes of air results in a considerable wastage of heat or fuel during the early stages of the drying process when the load and dryer are being brought up to drying temperature which, of course, has the effect of extending the time of the drying cycle.

SUMMARY OF THE INVENTION

I have found that if the rate of air movement through a dryer is reduced during the early stages of the drying process, less heat and fuel is wasted through the exhaust of the system, the load is more quickly brought up to drying temperature, the high output stage shuts off more quickly, and cycles on less.

More specifically, dryers are conventionally furnished with a damper to match the air flow rate through the dryer to the maximum capacity of the exhaust blower system. The more unimpeded the flow rate is through the dryer, the greater will be the current draw of the motor. To obtain maximum efficiency of the fan (or its motor) the flow passage is formed to overload the motor and then variably choked down to the stated current draw, to fit variations in installations and downstream exhaust configurations. Normally, once the damper is properly adjusted for optimum air flow it is left fixed in that position.

This invention contemplates an automatic control of that damper such that the air flow is sharply reduced when the dryer is started so as to permit an efficient application of the incoming hot air to the warming of the load and a discharge of such air as is exhausted in a relatively fully saturated condition. At a timed interval after start-up, the damper is opened to its predetermined position for maximum passage of air therethrough to flush out the residual moisture and to cool the load quickly after the flame is shut down.

It has been found that by the use of this invention, both fuel consumption and drying cycle time may be reduced by 20 to 25%.

The modification of a dryer to incorporate this capability is inexpensive and simple.

DESCRIPTION OF THE PREFERRED EMBODIMENT

Figure 1:
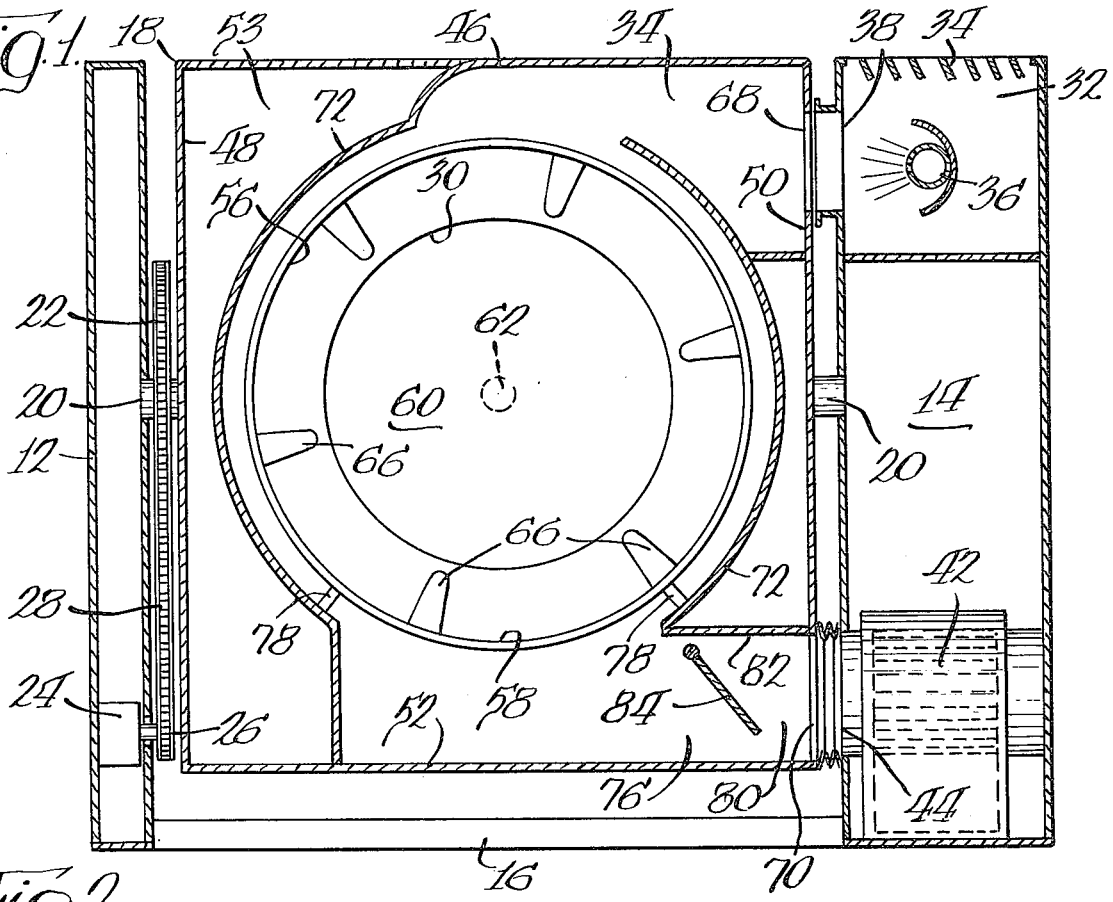
FIG. 1 is a front elevation of a dryer embodying the invention shown with certain covering panels removed.

Referring particularly to FIG. 1, the dryer shown comprises a pair of spaced, generally rectangular pedestals or towers, a support tower 12, and a control tower 14 connected by a tie 16 across the bottom. A dryer tumbler housing 18 is supported on trunnions 20 received in appropriate bearings in the two towers to support the housing for rotation. A driven sprocket 22 is mounted on the support tower trunnion 20. The tower 12 includes an internal motor 24 and an external driving sprocket 26 chain-28-connected to sprocket 22 for rotating the housing 18.

The housing has a loading port 30 in the front face thereof capable of being closed by doors (not shown), and the chain and sprocket assembly 22, 26, and 28 serve to rotate the housing so that the loading port may be faced upwardly to receive a charge of wet fabric from an overhead loader, be restored to the illustrated position where the loading port faces front in the drying position, and tilted somewhat downwardly to facilitate unloading. In some installations, the housing may be rotated so that the loading port faces directly downwardly for gravity unloading where the installation affords such space utilization or may be rotated through more than 180° to permit unloading on that side of the machine opposite to the loading side.

The control tower 14, in addition to the conventional controls which need not be described here, contains a combustion chamber 32 in its upper part having an air intake 34, a burner 36, and an outlet port 38 on that surface thereof facing the upper part of the tumbler housing. An exhaust fan 42 is situated in the bottom of the control tower having an intake 44 in the surface of the tower facing the lower part of the tumbler housing and an exhaust port 46 at the back of the control tower.

The tumbler housing 18 includes a top 46, sides 48 and 50 mounting the trunions 20, a floor 52, a front face 53 in which the loading port 30 is formed, and a back plate 54 to define a rectilinear enclosure. The housing is covered on all sides with insulation (not shown) for retention of heat and to make the dryer ambience comfortable.

The tumbler 56 is a cylindrical basket situated within the housing 18 having a perforated cylindrical wall 58 and a solid back wall 60. A trunnion 62 extends centrally outwardly from the back wall 60 through an appropriate hole in the plate 54 and is received in a bearing 64 on the back side of the plate 54. Ribs 66 extend from the cylindrical wall of the basket inwardly to agitate and tumble the fabrics placed therein. In the side wall 50 facing the control tower 14, a hot air inlet hole 68 and an air exhaust hole 70 are formed to conform to the hot air outlet port 38 of the combustion chamber 32 and the exhaust air inlet 44 for the blower 42. The ports 68 and 70 of the tumbler housing 18 conform to and register with the ports 38 and 44 respectively in the control tower when the housing 18 is in the illustrated drying position, and are exteriorly flanged to approach each other very closely to limit the introduction of ambient air. The fit between the exhaust ports 44 and 70 should be particularly close, and an adjustable telescoping flange may be provided on one of these openings to obtain the desired exactness of fit.

Shrouding 72 is provided within the drying compartment between the back plate 54 and the front face 53 of the housing to encompass the drying drum closely, to provide an air inlet passage 74 for incoming hot air and an outlet passage 76 communicating with the outlet port 70 for the exhaust of warm saturated air. Baffles 78 extend from the shrouding to the tumbler surface to prevent direct communication by way of the shrouding from the inlet 74 to outlet 76 and compel the passage of air between these passages through the perforations of the cylindrical wall of the tumbler 56. The exhaust end 80 of the outlet passage is formed by the floor 52 of the housing, a portion of shrouding 82 parallel thereto, the front face 53, and the back plate 54 to be rectangular in section, and communicates, as stated, directly with the outlet port 70. The damper 84 is contained in the exhaust end of the outlet passage.

Figure 2:
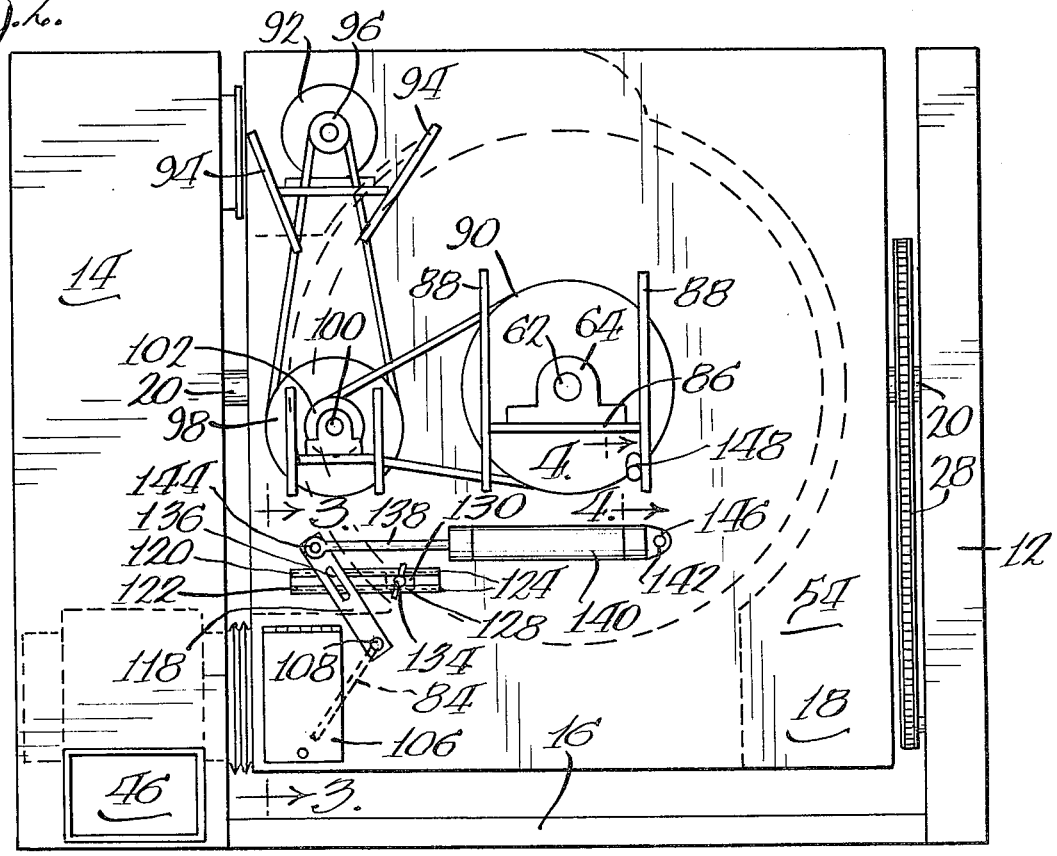
FIG. 2 is a rear elevation of the drier of FIG. 1.

FIG. 2 shows the back side of the dryer. The back plate 54 mounts in about its center the bearing 64 which contains the trunion 62 of the tumbler 56. The bearing is mounted on a horizontal shelf 86 welded along its edge to the back plate 54 and along its sides to the facing surfaces of vertical shelf ribs 88, elongated flat parallel plates welded along one of their long edges also to plate 54. The combination of the shelf 86 and the ribs 88 stiffens the back plate 54 to withstand the load imposed by damp fabrics within the tumbler and provides stable support for the trunion 62. The trunion 62 mounts a large diameter pulley 90. The tumbler motor 92 is mounted between inclined shelves 94 for belt tension adjustment and has a small pulley 96 thereon to belt-drive a large diameter pulley 98 mounted on a countershaft 100 which also carries a small diameter pulley 102 belt-connected to pulley 90. Countershaft 100 is mounted for rotation on a shelf 104 similar to the shelf 86. Thus, a double reduction of motor speed is effected which serves to rotate the basket at the desired slow rate of revolution to obtain a continuous tumbling of the contained fabric.

A clean-out door 106 is provided in the back plate, opening into the outlet passage adjacent its exhaust end for the removal of coins, buttons, etc. which may lodge therein.

The back of the housing 18 will be covered by removable screening (not shown) for reasons of safety.

Figure 3:
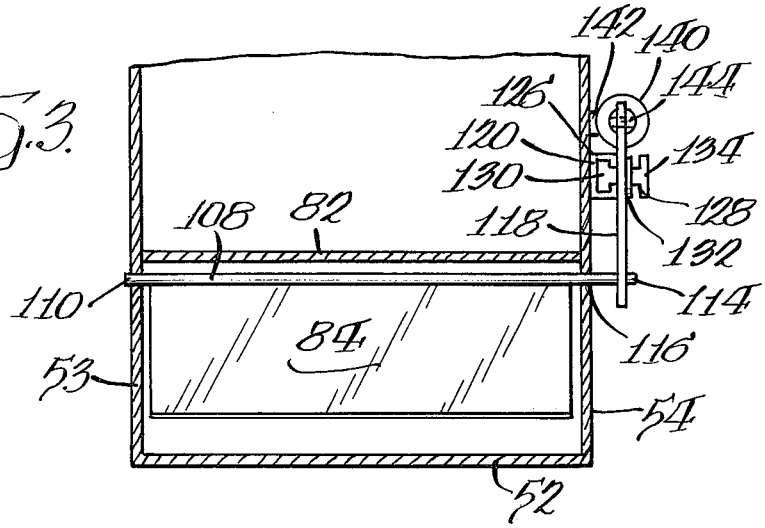
FIG. 3 is a part section, past elevation taken along the line 3—3 of FIG. 2 looking in the direction of the arrows.
Figure 4:
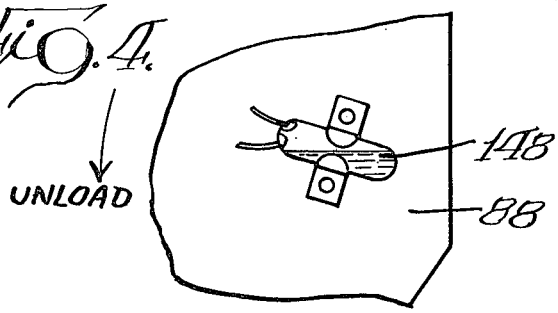
FIG. 4 is a fragmentary elevation of one of the bearing shelf ribs.

The damper 84 (FIG. 3) is a rectangular plate adapted to substantially close off the exhaust end 80 of the outlet passage and is welded to a steel shaft 108 along its top edge which has a projecting end 110 toward the front face 53 of the housing extending through an appropriate hole 112 in the front face but concealed behind the insulation covering the front face. The other end 114 of the shaft extends through a hole 116 in the back plate 54 to project substantially outward from the back plate and its covering insulation and has one end of a crank arm 118 welded thereto. The crank arm is oriented on shaft 108 such that it moves in an arc through a vertically upward position from the shaft end 94 as the damper moves between open and closed positions. Associated with the crank arm is a track member 120, a U-shaped bracket having a longitudinally slotted back portion 122 defining a pair of rails 124 extending horizontally and parallel to and spaced from the back plate 54 adjacent the inside surface of the crank arm 118, and a pair of inturned ends 126 by which the track is secured to the back plate 54 as by welding, etc. A clamp 128 is mounted to the rails to be fixed at any position therealong. The clamp consists of an internally threaded block 130 on the inside of the rails, a washer 132 on the outside of the rails and a thumb screw 134 for tightening the block and washer against the rails. The crank arm 118 has a slot 136 therein such that a portion of the slot overlies the space between the rails 124 throughout the range of movement of the crank arm. As normally furnished, the thumb screw of the clamp extends through the slot 136 of the crank 118 and the space between the rails 124. The damper 84 is adjusted to produce the rated current demand in the exhaust motor, and the thumb screw is tightened to clamp the crank to the rails 124 in a fixed position.

The device of the present invention will be described as a modification of the dryer described above in the way of an accessory package, although it may be provided as original equipment as will appear hereafter.

The present invention contemplates the operation of the damper 84 by a pneumatic cylinder between the position determined by the current draw of the blower motor as described above and a relatively closed position. The first of these positions will be referred to as the open position.

To this end, the crank 118 is disengaged from the clamp 128 and its upper free end is connected to the rod 138 of a pneumatic cylinder 140, which in turn is mounted to a post 142 secured to the back plate 54 of the housing.

More specifically, it will be noted from the drawings that the damper 84 is accessible through the clean-out door 106. For installation of the automatic air flow control, a one inch spacer is inserted between the lower edge of the damper 84 and the floor 52 of the housing 18. A hole is drilled at the top end of the crank 118. The rod 138 of the pneumatic cylinder 140 has a clevis 144 on the free end thereof which embraces free end of the crank and is pinned through the hole drilled therethrough. With the rod of the pneumatic cylinder 140 fully extended and the cylinder oriented generally parallel to the rails 124 and shortly thereabove, the location for the post 142 is ascertained and a hole drilled and tapped into the back plate 54 of the housing. Thereafter the post 142 is threaded into the hole and a headed bolt 146 is passed through an eye on the head end of the pneumatic cylinder 120 and into an appropriate threaded socket in the free end of the post 142. The clamp 128 is then adjusted on the rails to provide an abutment stop for the crank 118 at the desired open position.

A mercury switch 148 is mounted to the face of one of the shelf ribs 88 to be open when the housing 18 is in drying position but to close when the housing is rotated to load-discharge position with the loading port 30 faced downwardly.

Figure 5:
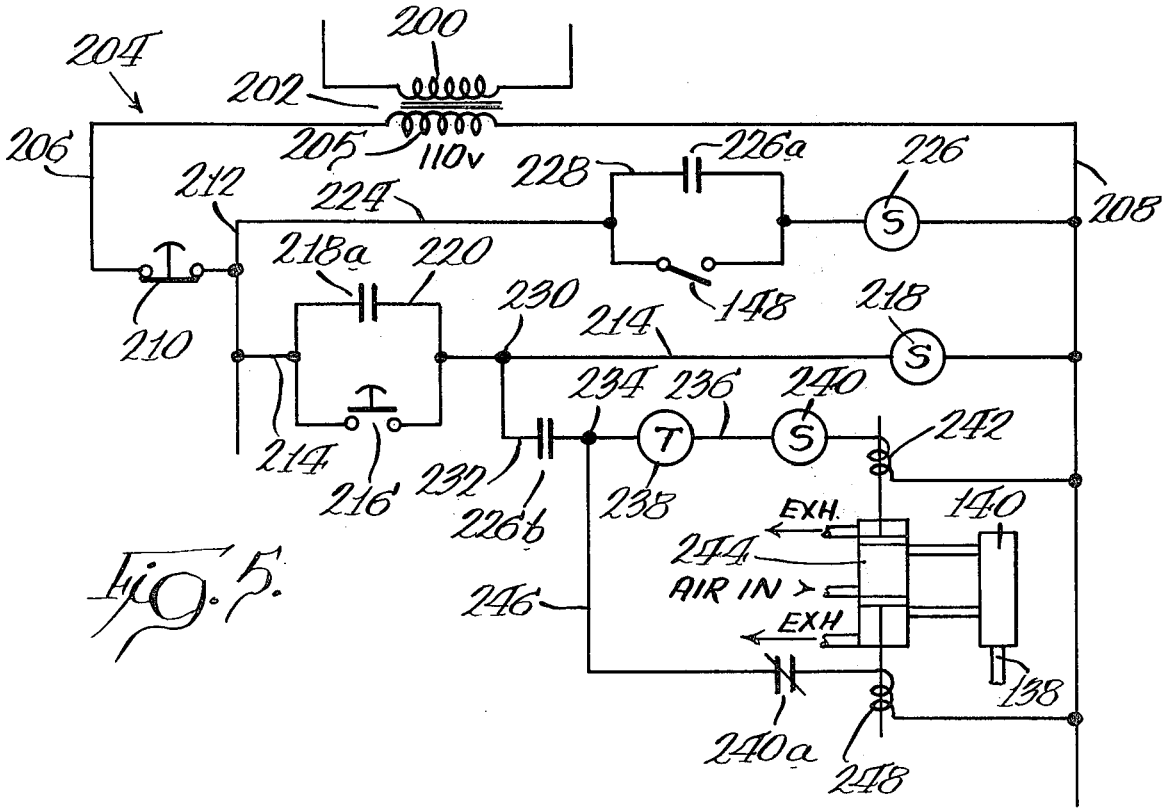
FIG. 5 is an electric and pneumatic circuit diagram of the invention.

The circuitry controlling the damper is illustrated in FIG. 5. The primary 200 of a transformer 202 powers a control circuit 204 through the transformer secondary 205. The primary is illustratively a 220 volt circuit which also powers the exhaust blower, the combustion blower, the basket motor, and the housing rotating motor with switches in the circuits to each of these under the control of elements in the control circuit 204. As the powering and the control of the motors is old and plays no part in this invention, illustration is believed unnecessary. Only that part of the circuit having to do with the variable exhaust air flow is illustrated.

The secondary 205 of the transformer is connected to line 206 on one side thereof and to line 208 on the other side thereof. Line 206 is connected through a normally closed stop switch 210 to a line 212. Line 212 is connected to line 208 across the transformer by a line 214 which includes a normally open starting switch 216 and a starting relay 218. The starting relay 218 includes normally open contacts 218*a* in a holding circuit 220 around the starting switch 216 to maintain energization of the starting relay 218.

It will be appreciated that the starting relay 218 also closes the circuit to the main blower and conditions the burner for operation which will start as soon as the appropriate vacuum has been developed by the main blower. Again, however, these aspects of the operation are old, and description is believed unnecessary.

Line 212 is also connected to line 208 by line 224 which includes the normally open mercury switch 148 and a relay 226. The mercury switch 148 has a holding circuit 228 thereabout with normally open, relay-226-actuated contacts 226*a* therein. A terminal 230 is situated in line 214 between the starting switch 216 and the relay 218, and a line 232 extends to terminal 234 and has normally open, relay-226-actuated contacts 226*b* therein. From terminal 234, a line 236 extends to line 208 and includes a timer 238, a relay 240, and a winding 242 on one side of a pneumatic directional control valve 244. The timer 238 is of the type which, when energized, conducts for the desired time period and then opens the circuit. Terminal 234 is also connected to line 208 by a line 246 which includes normally closed, solenoid-240-operated contacts 240*a* and the opposite winding 248 of pneumatic valve 244.

The operation of the circuitry is as follows. Prior to starting a cycle of drying operation, the dryer will have been emptied of a previous load by tilting the dryer housing 18, so closing mercury switch 148 and energizing relay 226 which in turn closes the holding contacts 226*a* of the holding circuit 228 for relay 226. The energized relay 226 also closes the contacts 226*b* in line 232. Before the start of the drying cycle, the housing is restored to its drying position, but the holding circuit 228, now being closed, continues energization of relay 226.

When the start button 216 is pushed, relay 218 is energized so closing the holding contacts 218*a* of the holding circuit 220 for relay 218. This energizes winding 242 of the pneumatic valve 244 through terminal 230, line 232, the now closed contacts 226*b*, the timer 238 and the relay 240. The valve 244 thus directs air under pressure into the head end of the pneumatic cylinder 140, so extending the rod 138 thereof to move the damper to its closed position. Winding 248 of the pneumatic valve 244 is deenergized by virtue of energization of the relay 240, so opening the normally closed contacts 240*a*.

The timer 238 is conductive for its predetermined time interval and at the expiration of the time, opens line 236. This deenergizes relay 240 and permits contacts 240*a* to close. Thus, winding 242 is deenergized and winding 248 is energized to move the valve 244 to its alternative position, so admitting air into the rod end of the cylinder 140 and moving the damper to its open position.

It will occasionally happen that a load of fabric, at the end of a drying cycle, will still not be fully dry. It is therefore necessary to start the dryer up again for a short period to complete the drying. Obviously, however, the damper should be open during such final drying, both for reasons of efficiency and speed of drying and to avoid damage to the fabrics from overheating which, in that nearly dry condition, are not protected by the cooling effect of the water. It is to this end that the mercury switch 148 is provided.

At the end of the estimated time of drying, the stop button 210 is operated, so breaking the circuit to the line 212. This deenergizes the relays 218 and 226 and thus breaks their associated holding circuits 220 and 228. With relay 226 deenergized, contacts 226*b* will open, leaving the pneumatic valve 244 in the position of directing pressure into the rod end of the cylinder 140. Assuming then that the fabrics are determined to be not completely dry and the start button is again pushed, the circuit to relay 226 will remain open by virtue of the open mercury switch 148 and the normally open, relay operated contacts 226*a*. Thus, contacts 226*b* remain open and the pneumatic valve 244 is unaffected by the restarting of the dryer. To condition the damper for reclosing, it is necessary to tilt the tumbler housing 18 to the fabric discharging position to close mercury switch 148 and energize relay 226. Thereafter, when a new load of wet fabric is introduced and the drying cycle started, the damper will again close.

The above description is directed to the invention in terms of accessory equipment for dryers as previously sold. A dryer embodying the invention as original equipment is very simply described. Such a dryer will lack the track member 120 and its associated clamp 128. A collar clamp can be adjustably fixed along the length of the projecting rod 138 of the cylinder 140 to limit the retraction of the rod and so determine the open position of the damper, the position which must be determined in reference to the current draw of the blower motor. The mercury switch 148 may be employed as a part of the original equipment dryer. Possibly better, however, is a cam operated switch reflecting rotation of the tumbler housing 18 from its drying position. The advantage of the mercury switch as a part of the accessory pack is its ease of installation.

The switch may respond to any position of the housing 18 incident to the loading process (of which unloading is a necessary part) or any displacement from the drying position which necessarily occurs in each drying cycle.

I claim:

1. In a fabric dryer of the type which includes a tumbler for containing wet fabric, means for supplying heated air to said tumbler, means for forcing air through said tumbler in a confined path, and an exhaust passage for said air; the improvement which comprises a damper in said exhaust passage movable between a relatively open position and a flow restricting position, means for moving said damper to said flow restricting position with the start of a drying cycle of said dryer and moving said damper to said relatively open position an interval after the start of said drying cycle, and means responsive to a condition incident to a reloading of the dryer for enabling said damper moving means for a next cycle of operation.

2. The combination as set forth in claim 1 wherein said condition responsive means is a switch adapted to be actuated when said tumbler is moved away from its normal axis of rotation in drying.

3. In a fabric dryer of the type which includes a tumbler for containing wet fabric, means for supplying heated air to said tumbler, means for forcing said air through said tumbler in a confined path, and an exhaust passage for said air; the improvement which comprises a damper in said exhaust passage movable between a relatively open position and a relatively closed, flow restricting position, means for moving said damper to said flow restricting position with the start of a drying cycle of said dryer and moving said damper to said relatively open position an interval after the start of said drying cycle, and means for preventing a reclosing of said damper upon a restart of said dryer unless said tumbler has been rotated away from the normal axis of rotation thereof in drying.

* * * * *